United States Patent [19]

Oler

[11] 4,294,448

[45] Oct. 13, 1981

[54] GAME APPARATUS

[76] Inventor: Newell B. Oler, 4323 Brown, Apt. 149, Dallas, Tex. 75219

[21] Appl. No.: 113,492

[22] Filed: Jan. 21, 1980

[51] Int. Cl.[3] ..... A63F 7/06; A63F 7/10

[52] U.S. Cl. ..... 273/94; 273/110; 273/116

[58] Field of Search ..... 273/94, 115, 116, 110, 273/113, 85 R

[56] References Cited

U.S. PATENT DOCUMENTS

| | | | |
|---|---|---|---|
| 2,433,769 | 12/1947 | Lander et al. | 273/94 |
| 2,562,126 | 7/1951 | Rishel | 273/110 |
| 2,658,755 | 11/1953 | Benak | 273/110 X |
| 2,760,776 | 8/1956 | Tullio | 273/94 |
| 3,384,374 | 5/1968 | Boothe | 273/116 X |
| 3,400,931 | 9/1968 | Thornton | 273/94 |
| 3,995,863 | 12/1976 | Cummins | 273/94 R X |
| 4,118,031 | 10/1978 | Westbrook | 273/110 |

*Primary Examiner*—George J. Marlo

*Attorney, Agent, or Firm*—Merchant, Gould, Smith, Edell, Welter & Schmidt

[57] ABSTRACT

Disclosed herein is a game apparatus (10) for simulating field games, such as football, with greater realism. The apparatus (10) includes a game board (18) attached to a frame (16) which is supported for pivotal movement about two mutually perpendicular axes. A plurality of fences (38) and apertures (40) on the game board (18) define an obstacle course for a roller ball (42). Handles (22, 24) are provided for selectively tilting the game board (18), which is normally spring-biased to a horizontal position, to maneuver the ball (42) through the obstacle course thereon. A passer/kicker (56) is provided for launching the game ball (42), as are a predetermined number of down pegs (68) for insertion into the apertures (40) to mark the progress of each team. Spinners (26–38) representing various play options and penalties are used when the ball (42) falls into certain predetermined apertures (40) on the game board (18).

12 Claims, 13 Drawing Figures

GAME APPARATUS

TECHNICAL FIELD

The present invention relates generally to a game. More particularly, this invention concerns a table game incorporating the labyrinth principle to simulate play of an actual field game, such as football, with greater realism.

BACKGROUND ART

Although many types of games have been developed for purposes of entertainment and amusement, such games have suffered from various drawbacks. For example, some games are relatively simple to learn and are thus easily mastered in a short time after which interest in the game diminishes to a point where little or no enjoyment is derived from playing the game. Other games are more difficult to learn and are thus more satisfying, but may be so time consuming to play and devoid of action that the participants become disinterested. A few games are so difficult to learn that it can become difficult in itself to find others with which to play the game.

Table games have become popular, and especially those simulating actual sports played on a field or court. In addition to the advantages of compact size and portability, the popularity of such table games in large part has been due to similarities between the table game and the actual game. The table games of the prior art, however, are marginally realistic at best due to the fact that the rules of play are only partially similar to those of the actual game. Table games based on actual sports games such as football, rugby, soccer or basketball have tended to be simplistic and thus unrealistic.

For instance, heretofore there has not been available a table game realistically simulating the game of football and its various offensive and defensive situations. A need has thus arisen for an improved table game having greater realism to an actual field game.

DISCLOSURE OF THE INVENTION

The present invention comprises a game apparatus which overcomes the foregoing and other disadvantages associated with the prior art. In accordance with the invention, there is provided a table game which utilizes the "labyrinth" principle. The game includes a rectangular game board simulating the field of play of the desired game, football for instance. The game board is mounted for movement and includes numerous obstacles about which a ball must be maneuvered by manipulation of the board. Play of the game herein requires some physical coordination and mental dexterity, and provides greater satisfaction due to its similarity to an actual game.

More specifically, the present invention comprises a simulated ball game including a pivotal board defining a field. The field is mounted for pivotal movement about longitudinal and lateral axes responsive to manipulation by the players. The field includes an arrangement of apertures and fences which define an obstacle course about which a ball must be maneuvered through manipulation of the field. A play ends when the ball falls into one of the apertures on the field. In accordance with the preferred construction, some of the apertures designate penalties or turnovers easily distinguished by a yellow dot in the penalty aperture and red dot in the turnover aperture. A manual passer/kicker apparatus is utilized in situations when it is desired to pass or kick the ball. Each side is allowed four plays or downs to manipulate the ball around the obstacles and thus achieve a score i.e., touchdown or field goal.

In the preferred embodiment, a plurality of wheels or spinners containing various offensive and defensive situations as well as penalties are used with the game for additional realism. These spinners provide a method for making the game as simple or complex as desired.

BRIEF DESCRIPTION OF DRAWINGS

A more complete understanding of the invention can be had by reference to the following Detailed Description in conjunction with the accompanying Drawings wherein.

DETAILED DESCRIPTION

Figure 1:
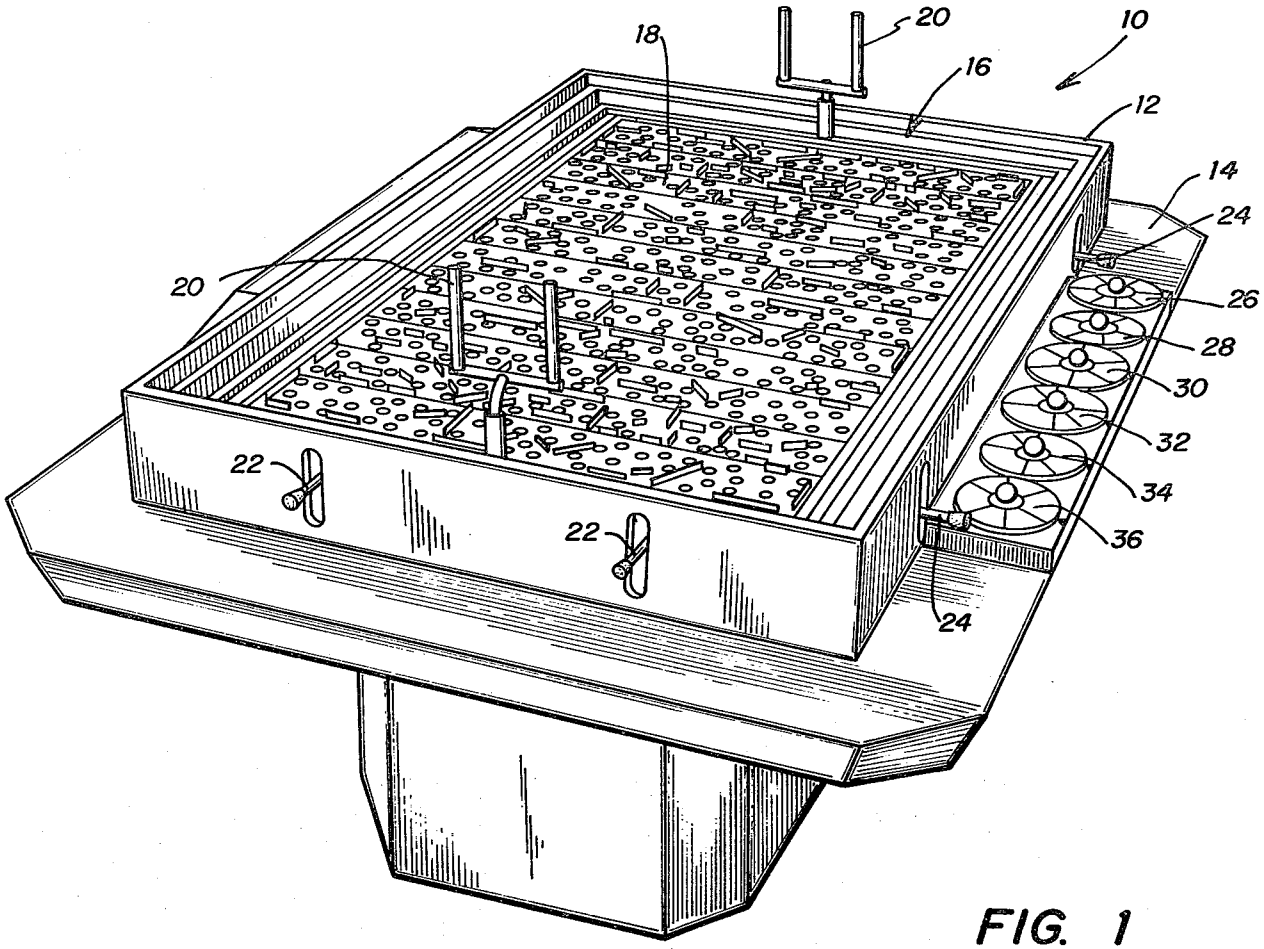
FIG. 1 is a perspective view of a game apparatus incorporating a first embodiment of the invention.

In the Drawings, like reference numerals designate like or corresponding parts throughout the several views.

Referring to FIG. 1, there is shown a game apparatus 10 incorporating the invention. The game apparatus 10 is particularly suited for simulating sport games of the type wherein a ball is moved by opposing teams over a playing field between scoring positions at opposite ends of the field. The game apparatus 10 disclosed and described herein is designed to simulate football and its rules of play. Game apparatus 10 can be played by two teams each comprising one or more players. As will be more fully discussed hereinafter, the components of game apparatus 10 permit play of simulated football with the realism of actual football and many of its aspects.

It will be understood, however, that while game apparatus 10 in its preferred embodiment is especially designed to simulate football, the apparatus can also be adapted to simulate rugby, soccer, basketball and other types of games played on a rectangular field or court.

Game apparatus 10 includes a rigid box 12 which is shown resting upon a level table 14. If desired, game apparatus 10 can be built into table 14. A frame 16 is supported for pivotal movement within the box 12. A simulated playing field or game board 18 is supported for movement on frame 16. A pair of goal posts 20 are mounted at opposite ends of game board 18. Movement of frame 16 and game board 18 is controlled through manipulation of handles 22 and 24 by the players of apparatus 10. A pair of handles 22 and 24 extending through vertical slots in box 12 are provided at each corner of apparatus 10. Levers, knobs or other suitable devices can be utilized to effect controlled pivotal movement of frame 16.

The game apparatus 10 further includes a number of wheels or spinners 26, 28, 30, 32, 34, and 36 simulating various offensive and defensive situations as well as penalties like those which occur during an actual football game. Spinners 24–36 will be described more fully hereinafter in connection with FIGS. 7–13.

Figure 2:
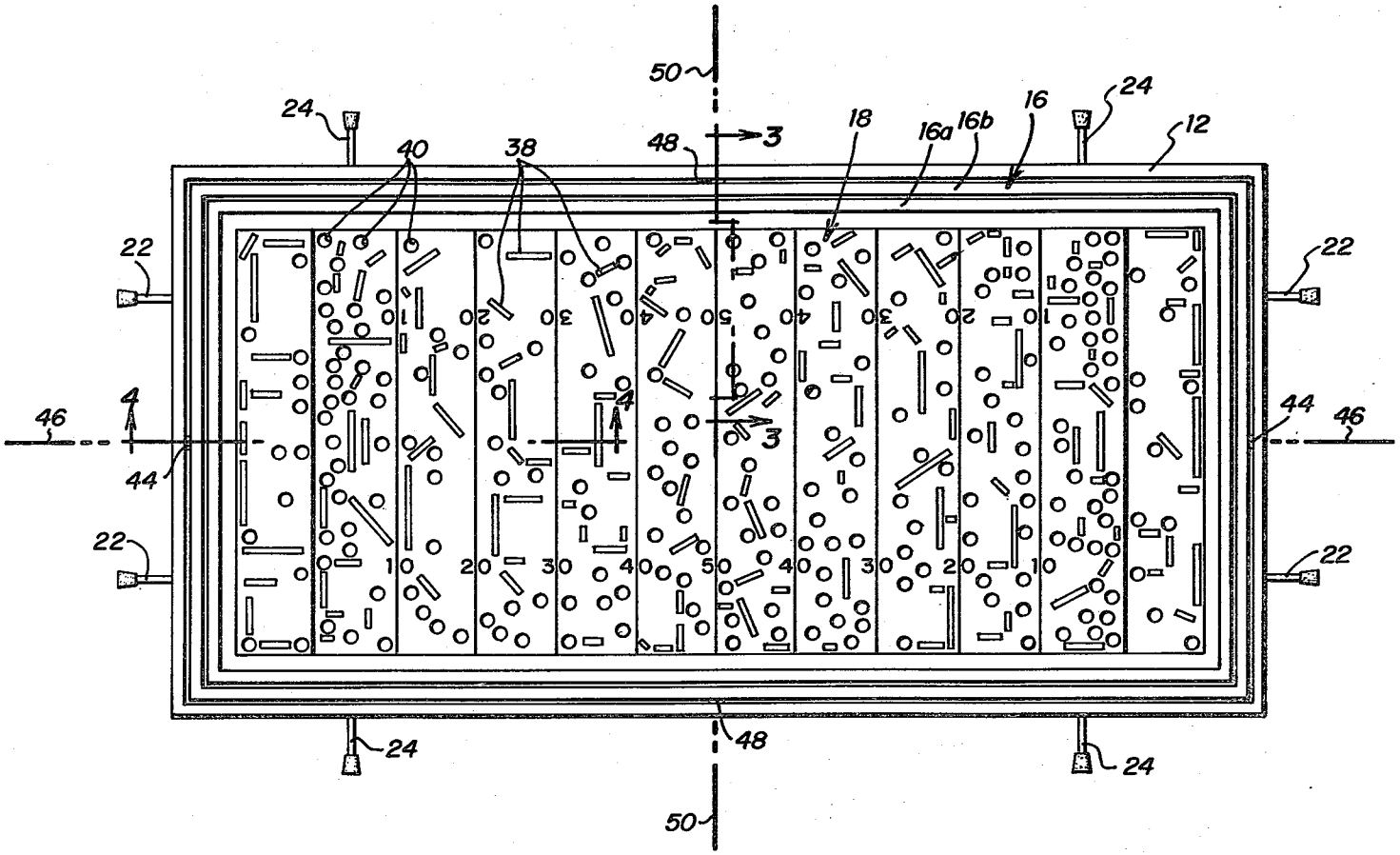
FIG. 2 is a plan view of the game apparatus.
Figure 3:
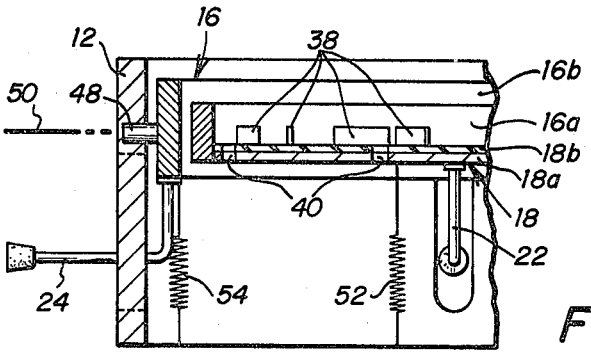
FIG. 3 is a section view taken generally along lines 3—3 of FIG. 2 in the direction of the arrows.
Figure 4:
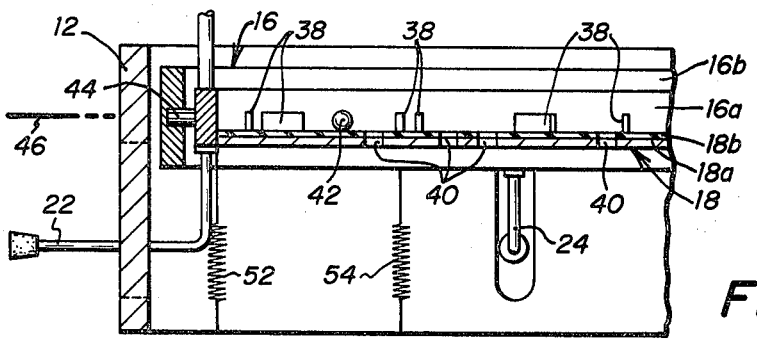
FIG. 4 is a section view taken generally along lines 4—4 of FIG. 2 in the direction of the arrows.

FIGS. 2, 3, and 4 illustrate the constructional details of box 12, frame 16 and game board 18. Game board 18 is rectangular and proportional in size to the game being simulated. For example, game board 18 can be 20 inches by 45 inches, which is a 4:9 relationship just like that between the width and length of an actual American football field. Game board 18 is divided into two end zones and ten intermediate zones each of which represents ten yards on an actual football field. It will thus be understood that game board 18 includes markings defining a miniature playing field.

Each of the zones on game board 18 includes a plurality of fences 38 and circular apertures 40. Fences 38 can be of various lengths, but all are of substantially uniform height sufficient to present a barrier to the roller ball 42 shown in FIG. 4. Apertures 40 are preferably of a size slightly smaller than ball 42 so that the ball will catch in a particular aperture but not fall through game board 18. Some of apertures 40 are designated "P" (yellow) or penalty apertures, while others are designated "T" (red) or turnover apertures, as will be explained more fully below.

A significant feature of the present invention comprises the fact that fences 38 and apertures 40 define an obstacle course on game board 18 through which ball 42 must be maneuvered. While the locations of apertures 40 are permanently fixed in game board 18, fences 38 can be fixed or movable. If desired, fences 38 can be selectively positioned on game board 18 by means of magnetism or the like. It will be appreciated that the degree of difficulty in playing game apparatus 10 can be adjusted by changing the relationship between between fences 38 and apertures 40.

Frame 16 is supported within box 12 for pivotal movement about two mutually perpendicular axes. Frame 16 comprises an inner frame portion **16*a* nested within an outer frame portion 16*b*. The inner frame portion 16*a* is pivoted to the outer portion 16*b* along a pair of trunions 44 defining a longitudinal pivot axis 46 as shown in FIG. 4. The outer frame portion 16*b* is pivoted to box 12 along a pair of trunions 48 defining a lateral pivot axis 50 as shown in FIG. 3. Handles 24 are secured to outer frame portion 16*b*, while handles 22 are connected to the inner frame portion 16*a***.

As is best shown in FIGS. 3 and 4, a pair of springs 52 and 54 is provided at each corner of box 12 beneath game board 18. Tension springs or elastic bands can be used for springs 52 and 54. Spring 52 interconnects inner frame portion **16*a* and box 12, while spring 54 interconnects outer frame portion 16*b* and the box. Springs 52 and 54 function to maintain frame 16 and game board 18 in a normally level orientation when handles 22 and 24** are not being manipulated.

In accordance with the preferred construction, the game board 18 is comprised of a rigid base layer **18*a* and a resilient top layer 18*b*. Base layer 18*a* may be constructed of plastic, wood, metal, or other appropriate material. Top layer 18*b* can be formed from elastomeric material of suitable thickness. This construction for game board 18** is advantageous because it eliminates the bouncing which would otherwise occur when the game ball is "passed" or "kicked".

Figure 5:
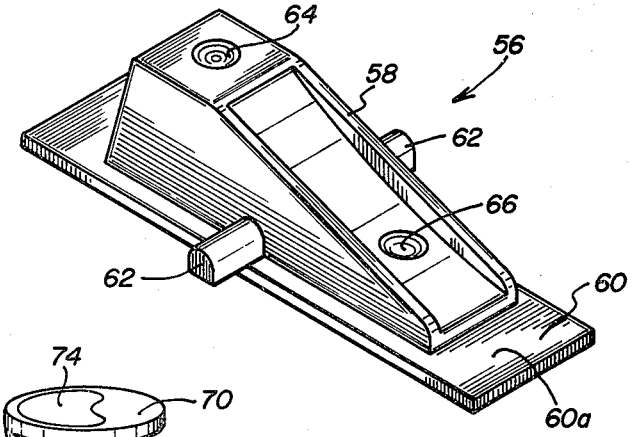
FIG. 5 is a perspective view of the passer/kicker device of the invention.

FIG. 5 illustrates the passer/kicker 56 which is utilized with game apparatus 10. Passer/kicker 56 includes a wedge-like body 58 which defines a grooved and inclined plane by which the game ball 42 is launched. Body 58 is mounted on a base 60. A pair of studs 62, which act as handles for steadying it with one hand while thumping with the other, are provided on opposite sides of body 58. When it is desired to "pass" the ball 42, the passer/kicker 56 is positioned over one of the fences 38 using the fence as a fulcrum, and the ball is placed into the upper recess 64 in body 58. The player then manually pops the end of the passer/kicker 56 at point **60*a* to catapult ball 42 and thereby launch the ball like an actual overhand pass. When it is desired to "kick" the ball, be it a kickoff, punt, or extra point attempt, the passer/kicker 56 is positioned on game board 18 and the ball 42 is placed in one of the two recesses. The lower recess 66 is for the kickoffs only where, in real football, a kicking tee is used. Placing the ball 42 in the lower recess 66 and letting the finger run up on the ball simulates a perfectly executed kickoff. To punt, kick field goals and extra points, the ball 42** must be centered back to the kicker finger with the other hand.

The thumb and longest finger of the other hand grips the handles or studs 62 while the index finger eases the ball 42 out of the top recess 64 down the inclined plane where the ball is thumped back up the inclined plane and into a high trajectory befitting a punt, etc.

Figure 6:
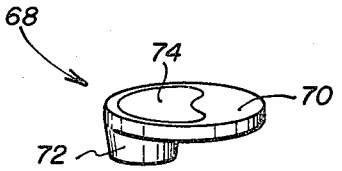
FIG. 6 is a perspective view of one of the down markers utilized in the invention.

FIG. 6 illustrates a down peg 68, several of which are employed with game apparatus 10. Down peg 68 comprises a disc 70 and an offset stud 72 for positioning in an aperture 40. A team insignia 74 is included on disc 70. Four down pegs 68 are provided for each team playing game apparatus 10. The number of down pegs 68 for each team corresponds to the number of downs or consecutive plays, such as four plays in a series, during which a team must score or relinquish the ball to the other team. Down pegs 68 are thus utilized to mark the progress of a team or player as he manuvers ball 42 over game board 18 by means of handles 22 and 24.

Simulated football is played as follows with game apparatus 10. After it is decided which team will get the ball first, such as by means of a coin toss, the ball 42 is placed on the 20 yard line in the kicking teams end of the field where it is kicked off by means using the passer/kicker 56 as mentioned above. A pair of handles 22 and 24 are then manipulated by one player on the receiving team to tilt game board 18 and thus cause ball 42 to progress down field. The objective is to control tilting of the frame portions **16*a* and 16*b* so as to maneuver ball 42 around fences 38 and between apertures 40. Fences 38 simulate barriers on the playing field about which ball 42 must be maneuvered. Fences 38 thus force various maneuvers of ball 42 between apertures 40. There is no penalty for contacting any of the fences 38 with ball 42**.

Should ball 42 fall into one of the apertures 40, any one of three different events next occurs. If the aperture 40 is unmarked, it signals the end of the particular play or down. If any downs remain in the alloted series, ball 42 is removed and play is resumed from that point either "on the ground" by rolling ball 42 over game board 18, or "in the air" by means of the passer/kicker 56. A down peg 68 is placed in each particular aperture 40 in which ball 42 fell in order to keep track of the number of downs or plays.

The consequences are more serious if ball 42 falls into an aperture 40 marked with "P" (yellow) to indicate a penalty, or marked with "T" (red) to indicate a turnover. In practice these apertures 40 are color coded red and yellow for easy recognition instead of with "P"'s and "T"'s. If ball 42 falls into a "P" (yellow) aperture 40, the opponent, at his discretion, may require the ball to be moved back a given distance. The penalty could be, for example, the length of a handspan so that an adult would be penalized relatively more than a child. The down would then be replayed following such a penalty.

If ball 42 falls into a "T" (red) aperture 40, possession of the ball would revert to the other team or player at that point on game board 18.

Each player or team is accorded the predetermined number of four downs in which to move ball 42 down field and score a touchdown or field goal. A series is defined as four downs so that each team will have ample opportunity to score, and yet provide for plenty of action. The rules regarding turnovers and penalties are substantially identical to those in the actual game of football.

FIGS. 7–13 depict the various wheels or spinners which are included in the preferred embodiment of game apparatus 10 for additional realism. The spinners represent various play options or penalites like those which arise during an actual football game. The letters "S" and "O" mean that a particular penalty is assessed from the line of scrimmage and the place where the infraction occurred, respectively. The plus and minus symbols indicate the direction of the penalty, with plus being against the defense and therefore for the offense and minus being against the offense and thus for the defense. The spinners of FIGS. 7–13 are all manually actuated. Each spinner is spun hard by a player on one team and stopped abrupty by a player on the other, if desired. The spinner is not allowed to come to a gradual stop.

Figure 7:
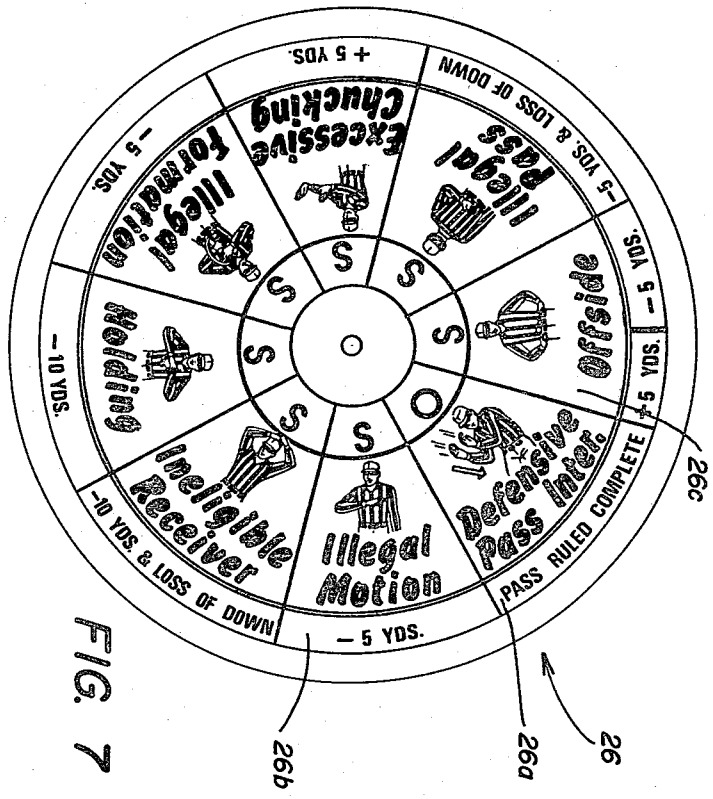
FIG. 7 is a plan view of the pass spinner of the invention.

Referring now to FIG. 7, there is shown the spinner 26. Instead of assessing a given penalty to a team when ball 42 falls into a "P" (yellow) aperture 40 after a passing play, spinner 26 can be utilized to penalize either the offense or the defense. Spinner 26 is divided into a plurality of zones representing various rule infractions and their penalties. For example, zone **26*a* signifies that defensive pass interference occurred and that the pass was ruled complete. Zone 26*b* signifies that the offense will be penalized five yards from the line of scrimmage for illegal motion. Depending upon where in zone 26*c* spinner 26 comes to rest with respect to a fixed pointer (not shown), either the offense or the defense could be penalized five yards from the line of scrimmage. The remaining penalties on spinner 26** are self-explanatory.

Figure 8:
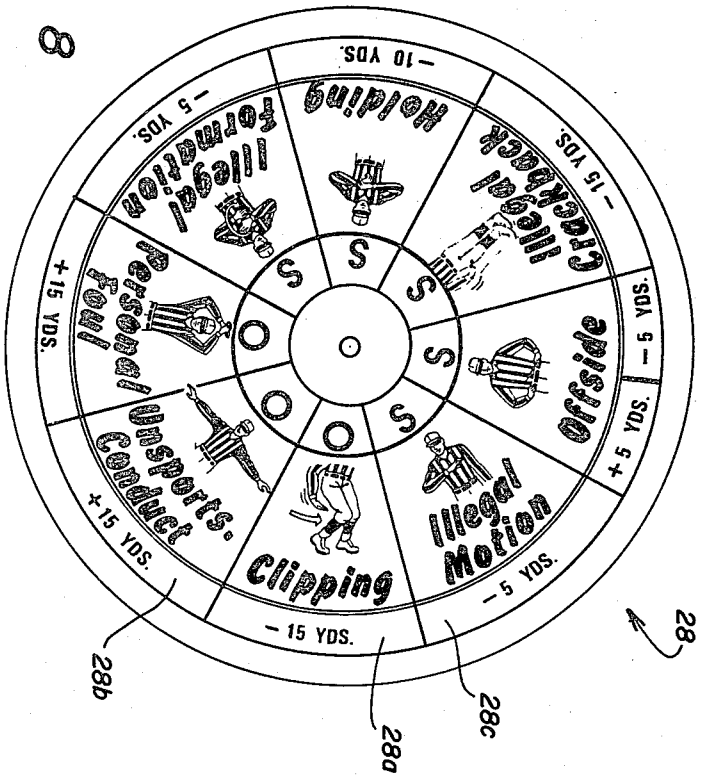
FIG. 8 is a plan view of the run spinner of the invention.

FIG. 8 shows a spinner 28 which can be used to determine the type of penalty when ball 42 falls into a "P" (yellow) aperture 40 during a running play. Spinner 28 can thus be employed in place of a set penalty. Spinner 28 is divided into a plurality of zones representative of various rule infractions and their penalties. For example, zone **28*a* signifies a clipping penalty of 15 yards against the offense from the place where the infraction occurred, which place is signified by the "O" in the innermost ring. Zone 28*b* signifies a penalty of unsportsmanlike conduct against the defense of 15 yards from the point where the infraction occurred. Zone 28*c* signifies an illegal motion penalty against the offensive of five yards from the line of scrimmage, which is designated by an "S". The other penalties defined by spinner 28** are self-explanatory.

Figure 9:
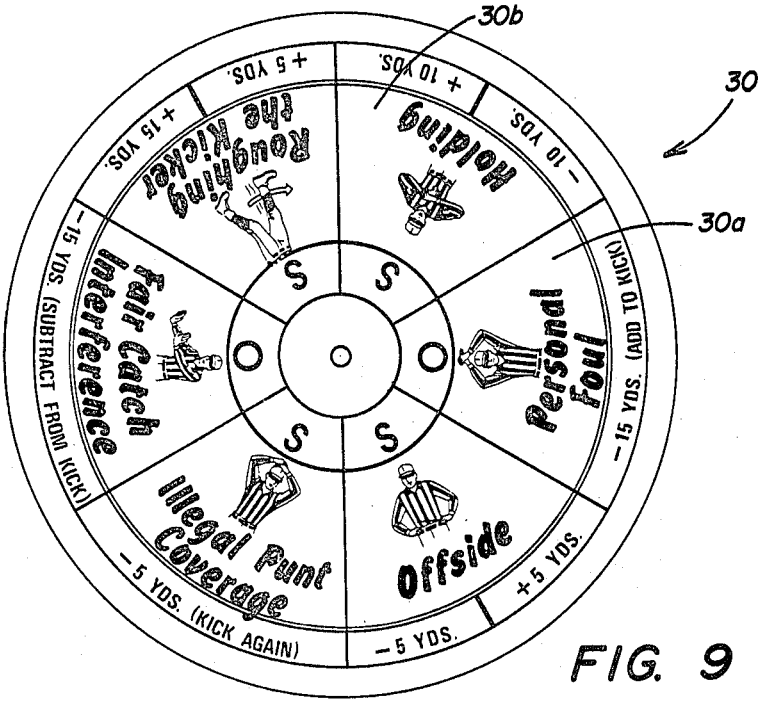
FIG. 9 is a plan view of the punt spinner of the invention.

FIG. 9 illustrates a spinner 30 which can be used to determine the penalty when ball 42 falls into a "P" aperture 40 after a punt. Like spinners 26 and 28 discussed above, spinner 30 is divided into a plurality of zones representative of various rule infractions and their penalties. For example, zone **30*a* signifies a personal foul penalty against the offense of 15 yards from the place where the infraction occurred. Zone 30*b* represents a holding penalty of ten yards from the line of scrimmage against the offense or the defense, depending upon where the pointer (not shown) is positioned within the zone after spinner 30 comes to rest. The other zones of spinner 30** are self-explanatory.

Figure 10:
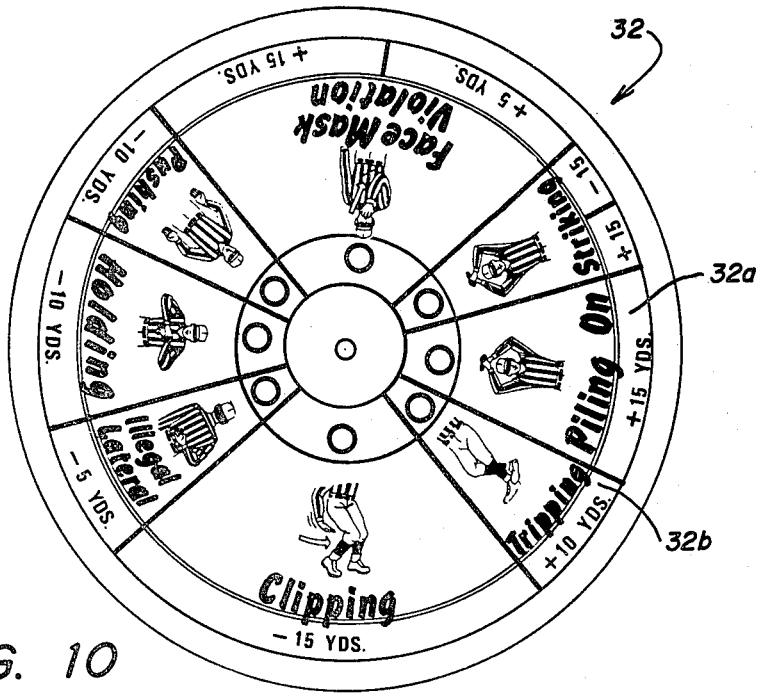
FIG. 10 is a plan view of the open field play spinner of the invention.

FIG. 10 shows spinner 32 which can be used to determine the penalty when ball 42 drops into a "P" aperture 40 after an open field play. By open field play, it is meant running with a completed or intercepted pass, or running with a recovered fumble, a punt, or a kickoff. Spinner 32 is divided into a plurality of radial zones signifying various infractions and their penalties. For example, zone **32*a* represents a piling-on penaly against the defense of 15 yards from the point of the infraction. Zone 32*b* signifies a tripping penalty against the defense of ten yards from the point of the infraction. The other zones of spinner 32** are self-explanatory.

Figure 12:
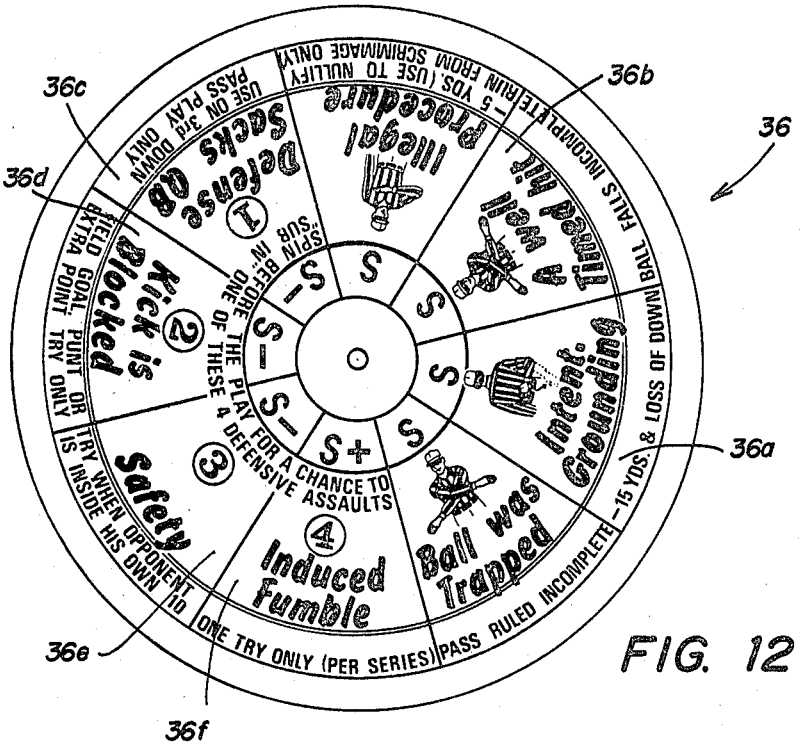
FIG. 12 is a plan view of the defensive assaults spinner of the invention.
Figure 11:
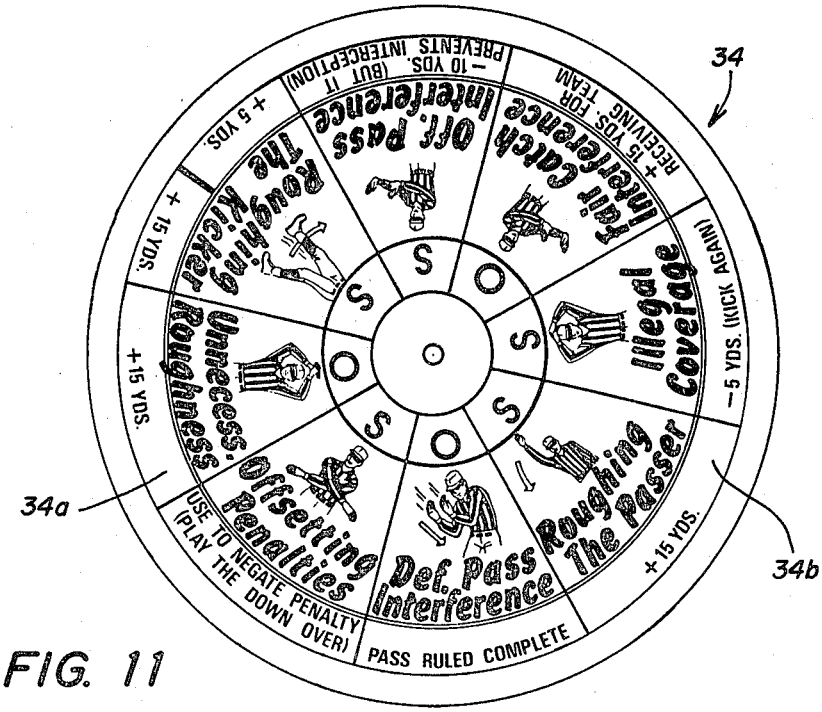
FIG. 11 is a plan view of the offensive fortuities spinner of the invention.

Spinners 34 and 36 in FIGS. 11 and 12 provide the offense and defense, respectively, to make crucial plays like those which occur during an actual football game. Spinner 34 comprises an offensive fortuities wheel, while spinner 36 comprises a defensive assaults wheel. If ball 42 falls into an unmarked aperture 40, thus signifying the end of a particular play, the offense may elect to try for a particular penalty against the defense, and thereby obtain additional yardage. Spinner 34 is divided into a plurality of zones representative of various rule infractions and their penalties. For example, zone **34*a* signifies an unnecessary roughness penalty against the defense of 15 yards from the place where the infraction occurred. Zone 34*b* signifies a 15 yard penalty from the line of scrimmage against the defense for roughing the passer. Spinner 36 is divided into similar penalty zones as well as calls by an official as to whether a particular play was good. For example, zone 36*a* signifies a penalty of 15 yards from the line of scrimmage plus loss of down against the offense for intentional grounding. Zone 36*b*** signifies an officials call of a well timed hit on an offensive receiver whereby the pass fell incomplete.

Spinners 34 and 36 are utilized as follows. Assume that the offense desires a roughing the passer penalty against the defense. The offense would so indicate, after which the defense would indicate which penalty or officials call it desires in that situation. One of the offensive players would then turn spinner 34 and attempt to stop it at the desired penalty. If spinner 34 does stop at the desired penalty, which is zone 34 in this example, then the offense would be allowed to advance ball 42 a distance corresponding to the penalty called against the defense.

If spinner 34 does not stop at the desired penalty called by the offense, then the defense has the opportunity to turn spinner 36 and stop it at the desired play to counter the offense. If spinner 36 stops on the desired penalty or officials call, then the defense gets credit for the play, otherwise nothing happens.

Spinner 36 also provides the defense with the opportunity to make one of four important defensive plays, which are indicated by zones 36*c–f* on the spinner. For example, 36*c* signifies a quarterback sack behind the line of scrimmage. Zone 36*f* signifies a fumble caused in front of the line of scrimmage. Zones 36*c–f* of spinner 36 each simulates an eror resulting in a loss of yardage or loss of possession of ball 42. Spinner 80 in FIG. 13 is utilized to determine where the quarterback was sacked, for example, as well as other questions.

Figure 13:
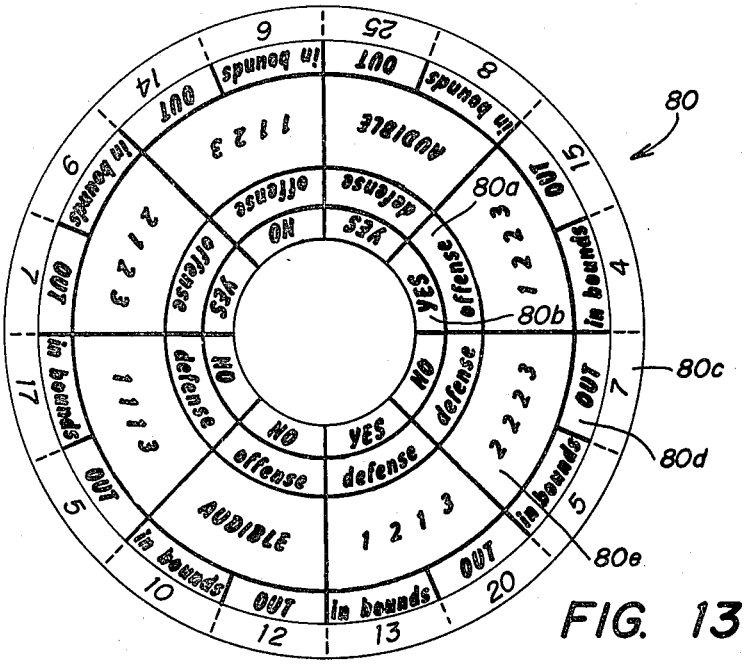
FIG. 13 is a plan view of the quarterback arbiter spinner of the invention.

FIG. 13 illustrates the quarterback orbiter spinner 80 which can be utilized with game apparatus 10 to make determination such as whether a fumble was recovered by the offense or the defense. Five separate determinations can be made by turning spinner 80. Ring 80*a* determines whether the offense or defense recovered a blocked kick, or fumble caused by the defense with zones 36*d, e* and *f* of spinner 36. Zone 80*b* decides whether the player or team recovering the fumble, for example, can then proceed to "run" with ball 42. Zone 80*c* is used to determine the number of yards away from the line of scrimmage the play, such as a quarterback sack, occurred. When the defense believes that the offense may have maneuvered ball 42 too close to the sidelines of game board 18, spinner 80 is turned and zone 80*d* thereon is read to decide whether the offense did step out of bounds. Finally, zone 80*e* is used to determine the types of plays in a series. In zone 80*e* the numerals 1, 2 and 3 mean run, pass and kick, respectively.

From the foregoing, it will be understood that the present invention comprises a novel game apparatus having numerous advantages over the prior art. One significant advantage of the invention involves the fact that the game is mor realistic to the actual game being simulated, thus affording greater satisfaction to the players and participants. The game herein is both manually and mentally challenging. Other advantages will suggest themselves to those skilled in the art.

Although particular embodiments of the invention have been illustrated in the accompanying Drawings and described in the foregoing Detailed Description, it will be understood that the invention is not limited to the embodiments disclosed, but is intended to embrace any alternatives, modifications, and rearrangements of elements as fall within the spirit and scope of the invention.

I claim:

1. A game apparatus for use with a ball, which comprises:

an outer frame supported for pivotal movement about a first axis;

a first handle secured to said outer frame;

an inner frame supported within said outer frame for pivotal movement about a second axis perpendicular to said first axis;

a second handle secured to said inner frame;

a planar game board defining a playing field mounted on said inner frame, said board including a plurality of apertures therein sized to receive the ball, certain ones of the apertures being designated penalty apertures;

spring means for normally biasing said inner and outer frames to urge said game board toward a horizontal orientation;

a plurality of fences attached to said game board so as to define, together with the apertures therein, an obstacle course for the ball; and spinner means for defining one of a plurality of predetermined rule infractions and penalties therefor to be applied when the ball enters a penalty aperture on said game board.

2. The game apparatus of claim 1, wherein said inner and outer frames and said game board are rectangular.

3. The game apparatus of claim 1, wherein the first and second axes are centrally positioned with respect to the outer and inner frames, respectively.

4. The game apparatus of claim 1, further including:

a goal post located at each end of said game board; and markings on said game board to define end zones and intermediate zones representative of a football field.

5. A game apparatus for use with a ball, which comprises:

a rectangular outer frame supported for pivotal movement about a first axis;

a rectangular inner frame supported within said outer frame for pivotal movement about a second axis;

said first and second axes being mutually perpendicular;

a rectangular game board defining a playing field mounted on said inner frame, said board including a plurality of apertures therein sized to receive the ball;

a plurality of fences attached to said game board so as to define, together with the apertures therein, an obstacle course for the ball;

certain ones of the apertures in said game board being designated penalty apertures;

means for manipulating said inner and outer frames to manuver the ball with respect to the fences and apertures on said game board; and spinner means for defining one of a plurality of rule infractions and penalties therefor to be applied when the ball falls into one of the penalty apertures on said game board.

6. The game apparatus of claim 5, wherein the first and second axes are centrally oriented with respect to the outer and inner frames, respectively.

7. The game apparatus of claim 5, further including:

goal posts located at each end of said game board; and markings on said game board to define end zones and intermediate zones representative of a football field.

8. The game apparatus of claim 5, wherein the means for manipulating said inner and outer frames comprises:

at least one first handle connected to said outer frame;

at least one second handle connected to said inner frame; and means for biasing said inner and outer frames to maintain said game board in normally level orientation.

9. Apparatus for playing simulated football with a round ball, comprising:

an outer frame supported for pivotal movement about a first axis;

an inner frame supported on said outer frame for pivotal movement about a second axis;

said first and second axes being mutually perpendicular;

a game board mounted on said inner frame;

goal posts located at opposite ends of said game board;

markings on said game board to define end zones, intermediate zones, and sidelines representative of a football field;

said game board including a plurality of apertures therein dimensioned to receive the ball;

a plurality of fences attached to said game board to define together with the apertures an obstacle course for the ball; and means for manipulating said inner and outer frames to maneuver the ball with respect to the fences and apertures on said game board.

10. The game apparatus of claim 9, wherein certain ones of the apertures in said game board are designated penalty apertures, and further including:

spinner means for defining any one of a plurality of predetermined rule infractions and penalties therefor to be applied when the ball falls into a penalty aperture.

11. The game apparatus of claim 9, wherein the first and second axes are centrally oriented in relation to the outer and inner frames, respectively.

12. The game apparatus of claim 9, wherein the means for manipulating said inner and outer frames comprises:

a first handle connected to said outer frame;

a second handle connected to said inner frame; and means for biasing said inner and outer frames to maintain said game board in normally level orientation.

* * * * *